US012742456B2

(12) United States Patent
Choi et al.

(10) Patent No.: US 12,742,456 B2
(45) Date of Patent: Sep. 22, 2026

(54) VERTICAL TYPE COMPRESSOR AND LAUNDRY TREATING APPARATUS HAVING THE SAME

(71) Applicant: LG ELECTRONICS INC., Seoul (KR)

(72) Inventors: Mingi Choi, Seoul (KR); Sangmo Kim, Seoul (KR); Dohyung Kim, Seoul (KR); Taeyeong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 19/332,243

(22) Filed: Sep. 18, 2025

(65) Prior Publication Data

US 2026/0126222 A1 May 7, 2026

(30) Foreign Application Priority Data

Nov. 1, 2024 (KR) ..... 10-2024-0153701

(51) Int. Cl.

| | |
|---|---|
| ***F04C 23/00*** | (2006.01) |
| ***D06F 58/20*** | (2006.01) |
| ***F01C 21/10*** | (2006.01) |
| ***F04B 39/12*** | (2006.01) |
| ***F04C 18/02*** | (2006.01) |

(Continued)

(52) U.S. Cl.

CPC ..... *F04C 23/008* (2013.01); *D06F 58/20* (2013.01); *F01C 21/10* (2013.01); *F04B 39/121* (2013.01); *F04C 18/0215* (2013.01); *F04C 18/3564* (2013.01); *F04C 23/001* (2013.01); *F04C 29/045* (2013.01); *F04C 2240/30* (2013.01); *F04C 2240/40* (2013.01); *F25B 31/026* (2013.01)

(58) Field of Classification Search

CPC .. F04C 23/008; F04C 18/3564; F04C 23/001; F04C 2240/30; F04C 18/0215; F04C 29/045; F04C 2240/40; F04B 39/121; F01C 21/10; D06F 58/20

See application file for complete search history.

(56) References Cited

U.S. PATENT DOCUMENTS

| | | | | |
|---|---|---|---|---|
| 7,726,020 | B2 * | 6/2010 | Ebara | F04C 23/001 417/220 |
| 10,294,941 | B2 * | 5/2019 | Nishimura | F04C 23/008 |
| 2004/0107595 | A1 * | 6/2004 | Kamimura | F04C 18/3564 34/218 |

FOREIGN PATENT DOCUMENTS

| | | |
|---|---|---|
| KR | 10-1982533 | 5/2019 |
| KR | 10-2336280 | 12/2021 |

* cited by examiner

*Primary Examiner* — Peter J Bertheaud
(74) *Attorney, Agent, or Firm* — KED & ASSOCIATES

(57) ABSTRACT

A vertical type compressor and a laundry treating apparatus having the same applied thereto according to the present disclosure includes a driving motor, a compression unit, and a casing. In the casing, a cap insertion portion expanded in a radial direction of a rotary shaft such that an opening end of a cap is inserted therein may be formed at an opening end of a middle shell formed in a cylindrical shape, and the opening end of the cap may overlap the driving motor in the radial direction of the rotary shaft. Accordingly, the height of the vertical type compressor is lowered, vibration of the vertical type compressor can be reduced, oil discharge from the compressor can be reduced, an insulation distance between the casing and the driving motor can be secured, and the assemblability of the casing can be ensured.

18 Claims, 7 Drawing Sheets

(51) Int. Cl.

| | |
|---|---|
| ***F04C 18/356*** | (2006.01) |
| ***F04C 29/04*** | (2006.01) |
| ***F25B 31/02*** | (2006.01) |

VERTICAL TYPE COMPRESSOR AND LAUNDRY TREATING APPARATUS HAVING THE SAME

CROSS-REFERENCE TO RELATED APPLICATION

Pursuant to 35 U.S.C. § 119(a), this application claims the benefit of the earlier filing date and the right of priority to Korean Patent Application No. 10-2024-0153701, filed on Nov. 1, 2024, the contents of which are incorporated by reference herein in their entirety.

BACKGROUND

1. Field

This disclosure relates to a vertical type compressor and a laundry treating apparatus having the same.

2. Description of the Related Art

A laundry treating apparatus refers to all apparatuses for managing or treating clothing, such as washing or drying clothing, bedding or the like, or removing wrinkles of clothing at home or in a laundry. The laundry treating apparatus may include a washing machine, a dryer, a washing machine/dryer (hereinafter, referred to as a washing/drying machine), and the like.

A dryer and/or a washing/drying machine supplies hot air to an object to be treated, such as clothing or bedding, which is put into a drum (or tub), thereby evaporating moisture contained in the object to be treated. In other words, the air which evaporates the moisture of the object to be treated in the drum and escapes from the drum contains the moisture of the object to be treated and hence is in a hot and humid state. The dryer and/or the washing/drying machine may be classified into a condensing type and an exhaust type depending on a method of treating the hot and humid air.

For example, the condensing type dryer does not discharge hot and humid air to outside but condenses moisture contained in the hot and humid air through heat exchange while circulating the air. In contrast, the exhaust type dryer directly discharges hot and humid air to outside. The condensing type dryer and the exhaust type dryer are structurally different from each other in that the condensing type dryer has a structure for treating condensate water and the exhaust type dryer has a structure for exhausting air. This is equally applied to the condensing type washing/drying machine.

The condensing type dryer and/or the condensing type washing/drying machine (hereinafter, the condensing type dryer is described as a representative example) performs a process of removing moisture through heat exchange from air discharged from a drum. Accordingly, the condensing type dryer (hereinafter, abbreviated as a dryer) includes a compressor for compressing a refrigerant necessary for a heat exchange process.

Conventionally, as a compressor was installed at an upper side of a cabinet of a dryer, i.e., upwardly of a drum, a horizontal type compressor was frequently applied by considering limitation of spaces. However, in the case of the horizontal type compressor, it is not easy to stably fix the compressor to the cabinet, and the reliability of products may be deteriorated as vibrations of the compressor and the dryer are further increased.

Therefore, an example, such as Patent Document 1 (Korean Registered Patent No. 10-1982533), in which a vertical type compressor is installed at a lower side of a cabinet of a dryer, i.e., a bottom surface of the cabinet, has recently been introduced. However, in this case, there is a problem that the height of the dryer should be raised by considering the height of the vertical type compressor or that the height of the vertical type compressor should be lower so as to lower the height of the dryer. In the case of the former, as the height of the dryer is raised with respect to the same capacity, manufacturing cost may be increased, and an increase in required installation space may be caused. On the other hand, in the case of the latter, it may be difficult to secure an insulation distance between a casing and a driving motor of the compressor, and the cooling power and/or reliability of the compressor may be deteriorated as a discharge space in the casing is decreased and hence oil discharge is increased.

This may become more serious particularly when a twin rotary compressor (hereinafter, referred to as a twin type rotary compressor) is applied. In a conventional twin type rotary compressor, such as Patent Document 2 (Korean Registered Patent No. 10-2336280), a first compression portion and a second compression portion are arranged along an axial direction, and may be formed to have a phase difference of 180 degrees. In the twin type rotary compressor, vibrations generated in both the compression portions are cancelled, so that the entire vibration of the compressor can be considerably reduced. Accordingly, compressor vibration in the dryer in which the compressor frequently performs a low speed operation, is considerably reduced, thereby reducing the vibration of the dryer. However, in the case of the twin type rotary compressor, as the first compression portion and the second compression portion are arranged along the axial direction as described above, the height of the compressor is raised while the total height of the compression portions is raised to that extent. Therefore, there is a problem that the height of the dryer is also raised.

In addition, in the conventional twin type rotary compressor, an upper cap is inserted into an upper end of a middle shell having a same inner diameter of both upper and lower ends, and may be coupled to a driving motor to be spaced apart from an upper end of the driving motor in the axial direction. Accordingly, the upper cap can be prevented from being interfered with the driving motor when the upper cap is assembled with the middle shell, and an insulation distance between a casing and the driving motor can be secured. However, in the conventional twin type rotary compressor, the height of the compressor is increased by an extent to which the upper cap is spaced apart from the upper end of the driving motor in the axial direction, and therefore, the height of the dryer is raised as described above.

SUMMARY

Therefore, the present disclosure provides a vertical type compressor capable of reducing vibration while lowering the height thereof and a laundry treating apparatus having the vertical type compressor.

The present disclosure also provides a vertical type compressor capable of securing an insulation distance between a casing and a driving motor while lowering the height thereof and a laundry treating apparatus having the vertical type compressor.

The present disclosure also provides a vertical type compressor capable of reducing an oil discharge amount while lowering the height thereof and a laundry treating apparatus having the vertical type compressor.

The present disclosure also provides a vertical type compressor capable of improving the assemblability of a casing while lowering the height thereof and a laundry treating apparatus having the vertical type compressor.

In order to achieve these and other advantages and in accordance with the purpose of this specification, as embodied and broadly described herein, there is provided a vertical type compressor including a driving motor, a compression unit, and a casing. The driving motor may include a stator in which a stator coil is wound around a stator core, a rotor rotatably arranged on an inner circumferential side of the stator, and a rotary shaft coupled to the rotor to rotate together with rotor. The compression unit may be arranged at one side of the driving motor, and may include at least one compression portion which compresses a refrigerant while being operated by a driving force transmitted through the rotary shaft. The casing may include a middle shell formed in a cylindrical shape and a cap inserted into an opening end of the middle shell to be coupled to the middle shell. The middle shell may include a body portion and a cap insertion portion. The body portion may accommodate the driving motor and the compression unit therein. The cap insertion portion may be arranged at one end of the body portion such that the cap is inserted thereinto, and may be expanded in a radial direction of the rotary shaft. Accordingly, the height of the vertical type compressor is lowered, so that a required space for installing the vertical type compressor can be minimized and vibration of the vertical type compressor can be reduced. Further, oil discharge from the compressor is reduced as an oil separation space of the vertical type compressor is expanded while lowering the height of the vertical type compressor, so that the cooling power and/or reliability of the compressor can be improved. Furthermore, as the cap forming a portion of the casing overlaps the driving motor in the radial direction, an insulation distance between the casing and the driving motor can be secured while lowering the height of the vertical type compressor. In addition, interference between the cap and the driving motor in assembly of the casing can be avoided while lowering the height of the vertical type compressor, so that the assemblability of the casing can be improved.

In an example, an opening end of the cap inserted into the cap insertion portion may overlap at least a portion of the driving motor in the radial direction of the rotary shaft. Accordingly, as a gap between the cap inserted into the cap insertion portion and the driving motor is widened, the oil separation space can be expanded while lowering the height of the vertical type compressor, the insulation distance between the casing and the driving motor can be secured, and the assemblability of the casing can be improved.

For example, a radial direction depth from an inner circumferential surface of the body portion to an inner circumferential surface of the cap insertion portion may be formed larger than or equal to a thickness of the opening end of the cap inserted into the cap insertion portion. Accordingly, the gap between the cap inserted into the cap insertion portion and the driving motor can be widened while lowering the height of the vertical type compressor.

In addition, an insulator may be located between the stator core facing the cap and the stator coil on a section of the stator core in an axial direction. At least a portion of the insulator may overlap the cap insertion portion in the radial direction of the rotary shaft. Accordingly, as the gap between the cap inserted into the cap insertion portion and the driving motor is widened, the insulation distance between the casing and the driving motor can be secured, and the assemblability of the casing can be improved.

Specifically, at least a portion of the insulator may overlap the opening end of the cap in the radial direction of the rotary shaft. Accordingly, the height of the vertical type compressor is lowered, so that the vertical type compressor can be installed even in a narrow space.

Specifically, a height from an upper end of the stator core facing the cap in the axial direction to an upper end of the insulator may be formed higher than or equal to a height from the upper end of the stator core to a lower end of the cap insertion portion and/or a height from the upper end of the stator core to the opening end of the cap inserted into the cap insertion portion. Accordingly, as the opening end of the cap overlaps the insulator of the driving motor in the radial direction, an insulation distance between the cap and the driving motor can be secured.

In another example, an insulator may be located between the stator core facing the cap and the stator coil on a section of the stator core in an axial direction. An outer circumferential surface of the insulator may be spaced apart from an inner circumferential surface of the opening end of the cap inserted into the cap insertion portion by a predetermined gap. Accordingly, the oil separation space is expanded while securing the insulation distance between the cap and the driving motor, so that an oil separation effect in the oil separation space can be improved.

For example, an inner diameter of the opening end of the cap inserted into the cap insertion portion may be formed larger than an outer diameter of the insulator. Accordingly, the gap between the cap and the driving motor is formed as wide as possible, so that the insulation distance can be secured and the oil discharge can be reduced.

In still another example, the cap may include a cover portion covering the opening end of the middle shell; and an insertion portion extending from the cover portion to be inserted into the opening end of the middle shell. An insulator may be located between the stator core facing the cap and the stator coil on a section of the stator core in an axial direction. A maximum axial direction gap between the insulator and an inner circumferential surface of the cover portion of the cap facing the insulator may be formed smaller than or equal to a height from an upper end of the stator core and an upper end of the insulator. Accordingly, an inner diameter in the oil separation space is expanded while lowering the height of the vertical type compressor, so that the oil separation effect in the oil separation space can be improved.

In still another example, the middle shell may have both open ends in an axial direction, a first cap and a second cap may be respectively inserted into both the ends of the middle shell in the axial direction to be coupled to the middle shell, and a refrigerant discharge pipe may be coupled to the first cap to communicate with an internal space of the casing. An inner diameter of the first cap may be formed larger than an inner diameter of the second cap. Accordingly, the oil separation effect in the oil separation space with which the refrigerant discharge pipe communicates can be improved, so that the oil discharge from the compressor can be effectively suppressed.

For example, the first cap may be located upwardly of the second cap with respect to an installation surface. Accordingly, oil is smoothly separated from the refrigerant discharged from the compression unit, so that the oil separation effect from the compressor can be improved.

In order to achieve these and other advantages and in accordance with the purpose of this specification, as embodied and broadly described herein, there is provided a laundry treating apparatus including a cabinet, a drum, and a compressor. The drum rotatably may be arranged inside the cabinet to accommodate clothing, and may have heated air provided thereto to dry the accommodated clothing. The compressor may be located between a bottom surface of the cabinet and the drum on the bottom surface of the cabinet. A vertical type compressor including a driving motor, a compression unit, and a casing may be provided as the compressor. The driving motor may include a stator in which a stator coil is wound around a stator core, a rotor rotatably arranged on an inner circumferential side of the stator, and a rotary shaft coupled to the rotor to rotate together with rotor. The compression unit may be arranged at one side of the driving motor, and may include at least one compression portion which compresses a refrigerant while being operated by a driving force transmitted through the rotary shaft. The casing may include a middle shell formed in a cylindrical shape and a cap inserted into an opening end of the middle shell to be coupled to the middle shell.

The middle shell may include a body accommodating the driving motor and the compression unit therein and a cap insertion portion arranged at one end of the body portion such that the cap is inserted thereinto, and expanded in a radial direction of the rotary shaft. Accordingly, compressor vibration can be reduced while lowering the height of the laundry treating apparatus to which the vertical type compressor is applied, an insulation distance of the vertical type compressor is secured, thereby improving the reliability of the laundry treating apparatus to which the vertical type compressor is applied, and oil discharge from the vertical type compressor is reduced, thereby increasing the energy efficiency of the laundry treating apparatus to which the vertical type compressor is applied.

In an example, the vertical type compressor may include a first compression portion and a second compression portion, each of which has a compression space. A first eccentric portion constituting the first compression portion and a second eccentric portion constituting the second compression portion may be formed along an axial direction on the rotary shaft. The first eccentric portion and the second eccentric portion may be formed with a phase difference of 180 degrees. Accordingly, compressor vibration can be reduced while lowering the height of the vertical type compressor, so that the vertical type compressor can be installed on the bottom surface of the laundry treating apparatus while lowering or maintaining the height of the laundry treating apparatus.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Hereinafter, a vertical type compressor and a laundry treating apparatus having the same according to the present disclosure will be described in detail, based on an embodiment illustrated in the accompanying drawings.

Compressors may be classified into a rotary compressor, a scroll compressor, a reciprocating compressor, and the like depending on a type of a compression unit (or compression mechanism unit) for compressing a refrigerant. A vertical type compressor according to an embodiment may include all compressors in which a stator of a driving motor constituting an electric unit is press-fitted into an inner circumferential surface, but an example in which a rotary compressor is applied will be mainly described. Therefore, hereinafter, the vertical type compressor may be understood as the rotary compressor unless otherwise specified.

In addition, although an example in which a twin type rotary compressor is applied will be mainly described in this embodiment, this may be equally applied even to a single type rotary compressor and/or a single vertical type compressor.

In addition, the laundry treating apparatus may include both a condensing type dryer and a condensing type washing/drying machine. However, hereinafter, the condensing type dryer will be mainly described. Therefore, hereinafter, the laundry treating apparatus may be understood as the condensing type dryer unless otherwise specified.

Figure 1:
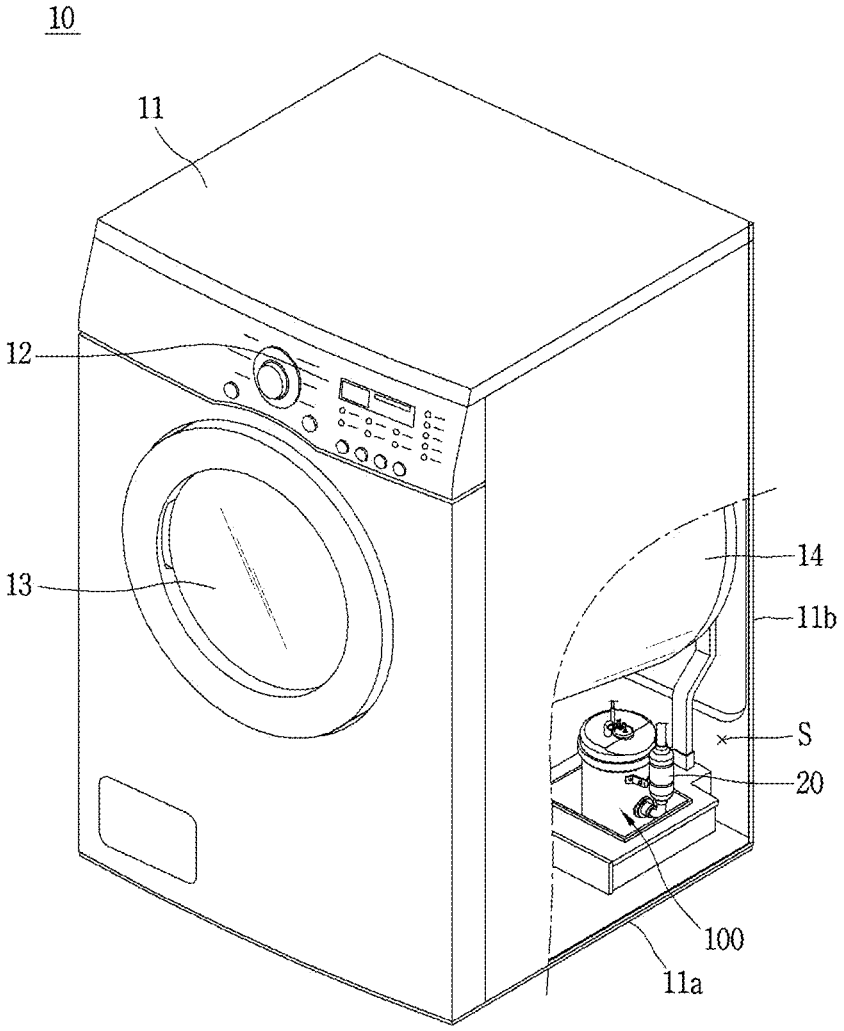
FIG. 1 is a perspective view showing a dryer having a vertical type compressor according to an embodiment.

FIG. 1 is a perspective view showing a dryer having a vertical type compressor according to an embodiment.

Referring to FIG. 1, a condensing type dryer (hereinafter, abbreviated as a dryer) 10 according to an embodiment may include may include a cabinet 11 corresponding to a body of the dryer. The cabinet 11 may be formed in a substantially rectangular parallelepiped shape, a control panel 12 which controls functions of the dryer 10 and displays states may be arranged at an upper side of a front portion of the cabinet 11, and a door 13 for putting an object to be dried into a drum 14 may be arranged below the control panel 12.

The drum 14 having an input port (no reference numeral) opened/closed by the door 13 may be rotatably arranged inside the cabinet 11. For example, the drum 14 may be spaced apart from a bottom surface 11*a* of the cabinet 11 by a predetermined gap to be rotatably arranged inside the cabinet 11.

In addition to the drum 14, a duct (not shown) which circulates and supplies heated air to the drum 14 and a heat pump (no reference numeral) which heats the circulated air passing through the duct and provides the heated air to the drum 14 may be arranged inside the cabinet 11. For example, the duct may communicate with each of both front and rear sides of the drum 14, and the heat pump may include a vertical type compressor 100 described above and be located between the bottom surface 11*a* of the cabinet 11 and the drum 14. In this case, a condenser (not shown) and an evaporator (not shown), which form a portion of the heat pump, may be located inside and/or outside the duct to perform heat exchange with the circulated air, and the vertical type compressor 100 forming another portion of the heat pump may be connected to the condenser and the evaporator via a refrigerant pipe (not shown) to be fixed directly to the bottom surface 11*a* of the cabinet 11 outside the duct or to be fixed with a compressor housing (no reference numeral) interposed therebetween.

The drum 14 may be formed in a substantially cylindrical shape to be arranged long in a front-rear direction inside the cabinet 11 having a substantially rectangular parallelepiped shape. Therefore, an empty space S having a substantially triangular shape may be formed between a vicinity of a lower corner of an inner surface 11*b* of the cabinet 11 and an outer circumferential surface of the drum 14 facing the same in front projection, and the vertical type compressor 100 having relatively low compressor vibration may be located in the empty space S. Accordingly, the vibration noise of the dryer 10 is lowered, so that the product reliability of the dryer 10 can be improved.

In the vertical type compressor 100, a driving motor 120 constituting an electric unit and a compression unit 130 constituting a compression mechanism, which will be described later, are arranged in a direction orthogonal or almost orthogonal to the bottom surface 11*a* of the cabinet 11 which forms an appearance of the dryer 10, and various types of compressors, such as a rotary compressor, a scroll compressor, and a reciprocating compressor, may be applied. However, in this embodiment, an example will be mainly described in which the rotary compressor is applied. Therefore, hereinafter, the vertical type compressor may be understood as the rotary compressor.

The vertical type compressor (hereinafter, referred to as the rotary compressor) 100 may include only one cylinder forming a compression space or may include a plurality of cylinders forming respective compression spaces, which are stacked in an axial direction. A rotary compressor including one cylinder may be defined as a single type rotary compressor, and a rotary compressor including a plurality of cylinders may be defined as a twin type rotary compressor. Hereinafter, a twin type rotary compressor (or twin rotary compressor) including two cylinders will be described as an example. However, this may be equally applied to the single type rotary compressor.

Figure 2:
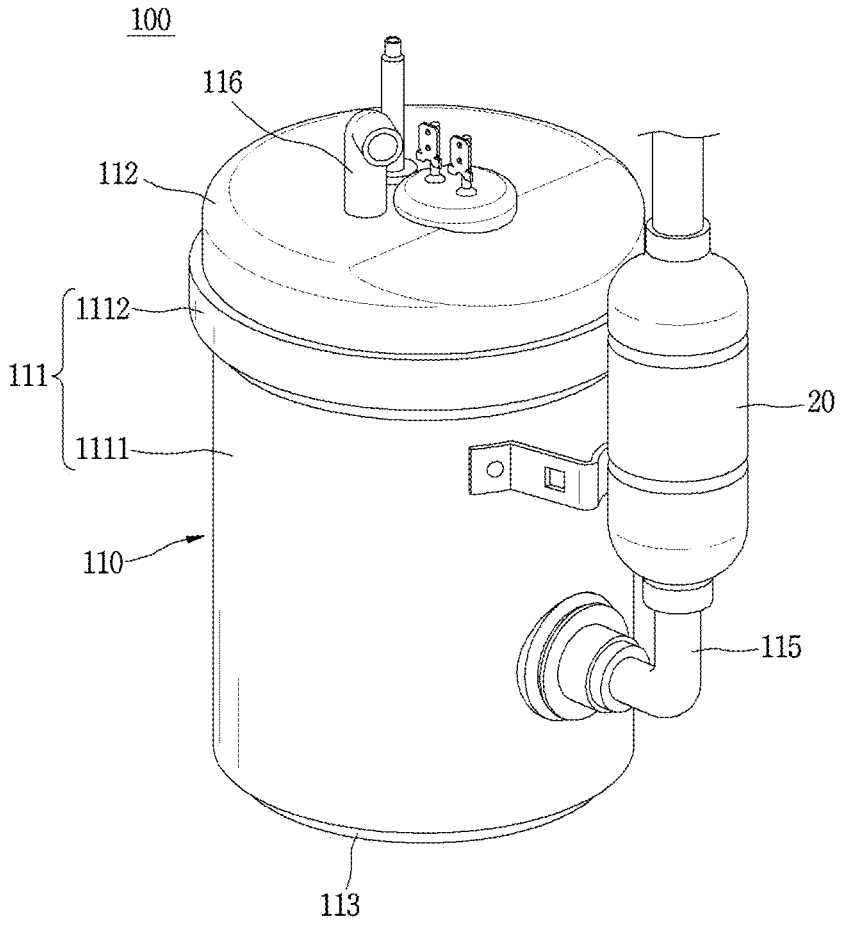
FIG. 2 is an assembled perspective view of an upper cap in the vertical type compressor according to this embodiment.
Figure 3:
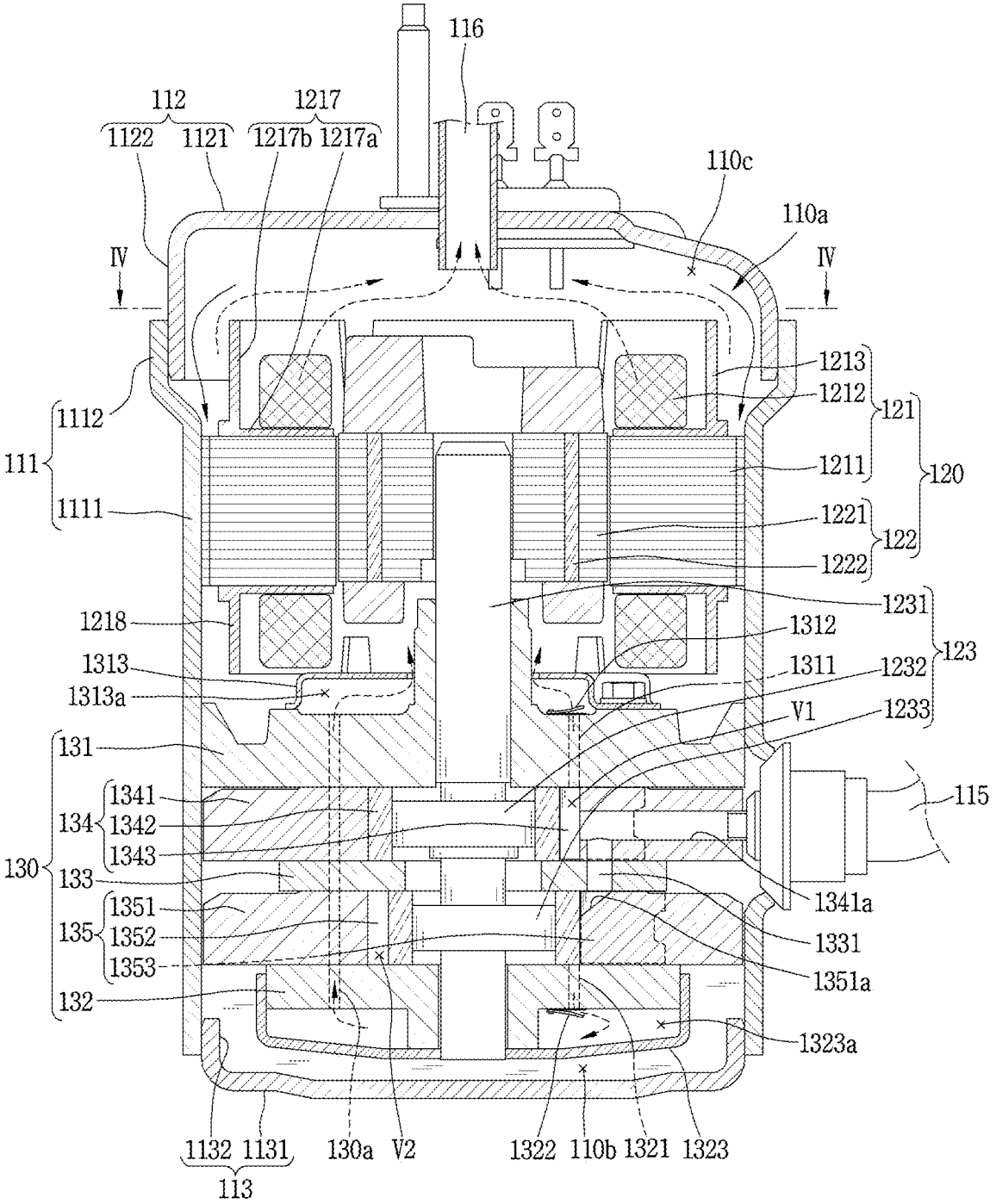
FIG. 3 is a cross-sectional view showing an interior of the vertical type compressor according to FIG. 2.
Figure 4:
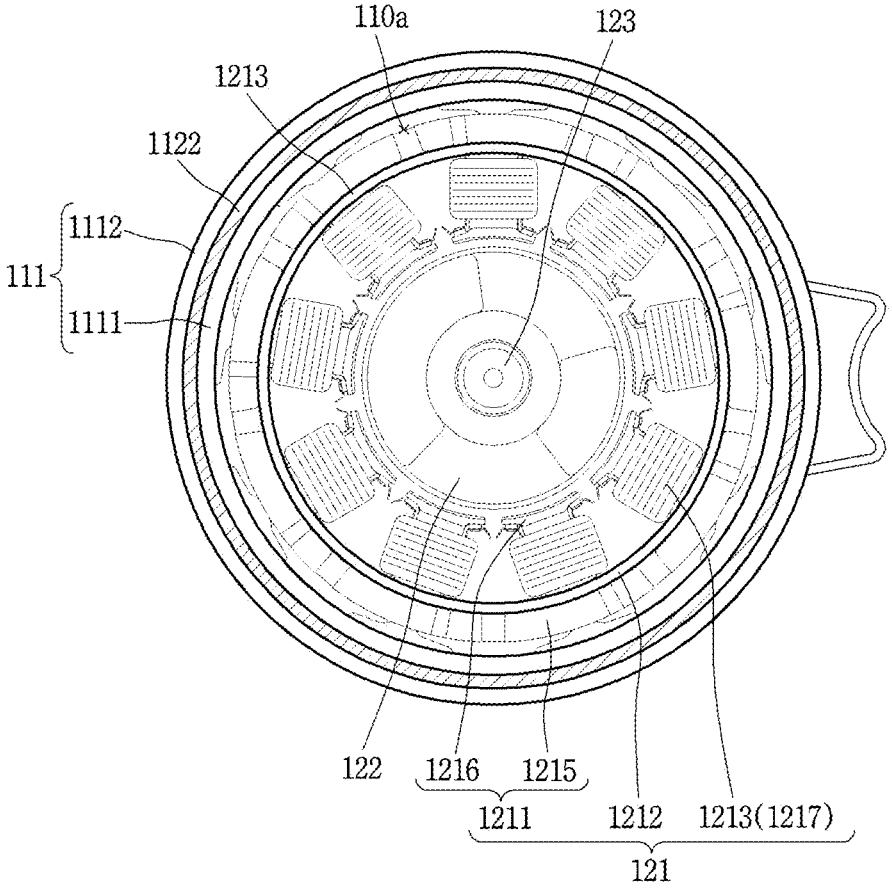
FIG. 4 is a cross-sectional view taken along line "IV-IV" of FIG. 3.

FIG. 2 is an assembled perspective view of an upper cap in the vertical type compressor according to this embodiment, FIG. 3 is a cross-sectional view showing an interior of the vertical type compressor according to FIG. 2, and FIG. 4 is a cross-sectional view taken along line "IV-IV" of FIG. 3.

Referring to FIGS. 2 to 4, in the twin type rotary compressor (hereinafter, abbreviated as a rotary compressor) 100 according to this embodiment, the driving motor 120 constituting the electric unit may be arranged in an internal space 110*a* of a casing 110, and the compression unit 130 which sucks and compresses a refrigerant and then discharges the compressed refrigerant to the internal space 110*a* of the casing 110 may be arranged below the driving motor 120. The driving motor 120 and the compression unit 130 may be mechanically connected to each other by a rotary shaft 123.

The casing 110 is a portion forming an appearance of the compressor, and may include a middle shell 111, an upper cap (or first cap) 112, and a lower cap (or second cap) 113. Both upper and lower ends of the middle shell 111 are open, and the upper cap 112 and the lower cap 113 seal the internal space 110*a* of the casing 110 by respectively covering both the upper and lower ends of the middle shell 111. Therefore, an oil storage space 110*b* and an oil separation space 110*c* may be formed in a lower half portion and an upper half portion of the internal space 110*a* of the casing 110, respectively.

In this case, a body portion 1111 accommodating the driving motor 120, the compression unit 130, and the lower cap 113 therein may be formed in a lower half portion of the middle shell 111, and a cap insertion portion 1112 accommodating the upper cap 112 therein may be formed in an upper half portion of the middle shell 111. The body portion 1111 may be formed in a cylindrical shape, and the cap insertion portion 1112 may be formed in an annular shape expanded larger than an inner diameter of the body portion 1111. The middle shell 111 including the cap insertion portion 1112 will be described again later.

In addition, a refrigerant suction pipe 115 connected to an exit side of an accumulator 10 may be coupled to the lower half portion of the middle shell 111, i.e., a lower half portion of the body portion 111 to pass through the middle shell 111, and a refrigerant discharge pipe 116 connected to an entrance side of the condenser (not shown) via the refrigerant pipe (not shown) may be coupled to the upper cap 112 to pass through the upper cap 112. The refrigerant suction pipe 115 may be connected directly to a first suction port 1341*a* of a first cylinder 1341 to be described later while passing through the middle shell 111, and the refrigerant discharge pipe 116 may directly communicate with the internal space 110*a*, i.e., the oil separation space 110*c* while passing through the upper cap 112. Therefore, the internal space 110*a* of the casing 110 forms a high pressure compressor filled with the refrigerant discharged from a first compression space V1 and/or a second compression space V2, which will be described later.

Referring to FIGS. 3 and 4, the driving motor 120 constituting the electric unit according to this embodiment may include a stator 121, a rotor 122, and the rotary shaft 123. The stator 121 may be press-fitted into the casing 110 to be fixed to the casing 110, and the rotor 122 may be rotatably inserted into the stator 121. The rotary shaft 123 may be coupled to a center of the rotor 122.

The stator 121 may include a stator core 1211, a stator coil 1212, and an insulator 1213. The stator core 1211 may be press-fitted into the middle shell 111 to be fixed to the middle shell 111, the stator coil 1212 may be wound around the stator core 1211, and the insulator 1213 may be located between the stator core 1211 and the stator coil 1212. The stator 121 along with the casing 110 will be described again later.

The rotor 122 may include a rotor core 1221 and permanent magnets 1222. The rotor core 1221 may be rotatably arranged inside the stator core 1211, and the permanent magnets 1222 may be embedded at a predetermined gap along a circumferential direction inside the rotor core 1221.

The rotary shaft 123 may include a shaft portion 1231, a first eccentric portion 1232, and a second eccentric portion 1233. The shaft portion 1231 forming one end of the rotary shaft 123 may coaxially extend from a shaft center of the rotary shaft 123 to be press-fitted into the center of the rotor 122, and the first eccentric portion 1232 and the second eccentric portion 1233, which form the other end of the rotary shaft 123, may be eccentrically formed with respect to the shaft center of the rotary shaft 123 such that a first roller 1342 and a second roller 1352, which will be described later, are eccentrically coupled to the first eccentric portion 1232 and the second eccentric portion 1233, respectively. The first eccentric portion 1232 and the second eccentric portion 1233 constitute portions of a first compression portion 134 and a second compression portion 135, which will be described later, respectively, and may be eccentrically formed with a phase difference of about 180 degrees along the circumferential direction. Therefore, the first compression portion 134 and the second compression portion 135, which will be described later, along with the first eccentric portion 1232 and the second eccentric portion 1233 may perform a compression cycle with a phase difference of about 180 degrees. Accordingly, in the twin type rotary compressor according to this embodiment, vibrations generated in the first compression portion 134 and the second compression portion 135 are cancelled, so that compression vibration can be considerably reduced.

Referring to FIG. 3, the compression unit 130 according to this embodiment may include a main bearing plate (hereinafter, referred to as a main bearing) 131, a sub-bearing plate (hereinafter, referred to as a sub-bearing) 132, a middle plate 133, the first compression portion 134, and the second compression portion 135. The first compression portion 134 and the second compression portion 135 may be respectively formed at both sides of the rotary shaft 123 in the axial direction with the middle plate 133 interposed therebetween.

The main bearing 131 may be fixedly coupled to an inner circumferential surface of the middle shell 111. A first discharge port 1311 discharging the refrigerant compressed in the first compression space V1 may be formed in the main bearing 131, and a first discharge valve 1312 opening/closing the first discharge port 131 may be arranged at an end portion of the first discharge port 1311. A first discharge cover 1313 having a first discharge space 1313*a* may be arranged on one side surface of the main bearing 131. The first discharge cover 1313 may be open toward the internal space 110*a* of the casing 110. Therefore, the refrigerant discharged to the first discharge space 1313*a* of the first discharge cover 1313 is discharged to the internal space 110*a* of the casing 110 such that the internal space 110*a* of the casing 110 forms a discharge pressure.

Although not shown in the drawing, the sub-bearing 132 may be fixed to the middle shell 111, and the main bearing 131 may be fastened to the sub-bearing 132 or both the main bearing 131 and the sub-bearing 132 may be fixed to the middle shell 111. In addition, the first cylinder 1341 and/or the second cylinder 1351, which will be described later, may be fixed to the middle shell 111, and the main bearing 131 and the sub-bearing 132 may be fastened to the first cylinder 1341 and/or the second cylinder 1351 to be supported by the first cylinder 1341 and/or the second cylinder 1351.

The sub-bearing 132 may be bolt-fastened to the main bearing 131 with the first compression portion 134 and the second compression portion 135, including the middle plate 133, which are interposed therebetween, to be supported by the main bearing 131. A second discharge port 1321 discharging the refrigerant compressed in the second compression space V2 may be formed in the sub-bearing 132, and a second discharge valve 1322 opening/closing the second discharge port 1321 may be arranged at an end portion of the second discharge port 1321. A second discharge cover 1323 having a second discharge space 1323*a* may be arranged on one side surface of the sub-bearing 132. The second discharge cover 1323 may be open toward the internal space 110*a* of the casing 110. In addition, a refrigerant flow path 130*a* allowing the second discharge space 1323*a* to communicate with the first discharge space 1313*a* therethrough may be formed in the sub-bearing 132, the second cylinder 1351 to be described later, the middle plate 133, the first cylinder 1341 to be described later, and the main bearing 131. Therefore, the refrigerant discharged to the second discharge space 1323*a* of the second discharge cover 1323 is moved to the first discharge space 1313*a* through the refrigerant flow path 130*a* and then discharged together with the refrigerant discharged from the first compression space V1 to the internal space 110*a* of the casing 110, so that the internal space 110*a* of the casing 110 forms the discharge pressure.

Although not shown in the drawing, the second discharge cover 1323 may be open toward the internal space 110*a* of the casing 110. In this case, the separate refrigerant flow path 130 may be excluded.

The middle plate 133 may be formed in an annular shape having an inner diameter larger than an inner diameter of the sub-bearing 132. In other words, the middle plate 133 may be formed in an annular shape having an inner diameter larger than an outer diameter of the first eccentric portion 1232 and/or the second eccentric portion 1233 of the rotary shaft 123. Therefore, the middle plate 133 may be assembled to be located between the first compression portion 134 and the second compression portion 135.

In addition to the refrigerant flow path 130*a*, a communication hole 1331 allowing the first suction port 1341*a* and a second suction portion 1351*a* to communicate with each other therethrough may be formed in the middle plate 133. Therefore, a portion of the refrigerant sucked into the first compression space V1 through the refrigerant suction pipe 115 is guided to the second compression space V2 through the communication hole 1331 such that the first compression portion 134 and the second compression portion 135 can alternately perform the compression cycle in sequence.

The first compression portion 134 may include the first cylinder 1341, the first roller 1342, and a first vane 1343. The first cylinder 1341 includes the first suction port 1341*a* and is fixedly coupled between the main bearing 131 and the middle plate 133, the first roller 1342 is provided to the first eccentric portion 1232 to performs a rotational motion, and the first vane 1343 is slidingly inserted into the first cylinder 1341 to be allowed to reciprocate linearly by the first roller 1342. Therefore, the first compression portion 134 compresses the refrigerant sucked through the first suction port 1341*a* and discharges the compressed refrigerant to the first discharge space 1313*a* of the first discharge cover 1313 through the first discharge port 1311 of the main bearing 131 while forming the first compression space V1 inside the first cylinder 1341.

The second compression portion 135 may include the second cylinder 1351, the second roller 1352, and a second vane 1353. The second cylinder 1351 includes the second suction port 1351*a* and is fixedly coupled between the sub-bearing 132 and the middle plate 133, the second roller 1352 is provided to the second eccentric portion 1233 to perform a rotational motion inside the second cylinder 1351, and the second vane 1353 is slidingly inserted into the second cylinder 1351 to be allowed to reciprocate linearly by the second roller 1352. Therefore, the second compression portion 135 compresses the refrigerant sucked through the second suction port 1351*a* and discharges the compressed refrigerant to the second discharge space 1323*a* of the second discharge cover 1323 through the second discharge port 1321 while forming the second compression space V2 inside the second cylinder 1351.

Although not shown in the drawing, in the first compression portion 134 and/or the second compression portion 135, the first vane 1343 and/or the second vane 1353 may be respectively hinge-coupled to the first roller 1342 and/or the second roller 1352 to compress the refrigerant, or the first vane 1343 and/or the second vane 1353 may be respectively slidingly coupled to the first roller 1342 and/or the second roller 1352 to compress the refrigerant. In these cases, the first compression portion 134 and the second compression portion 135 may be arranged in the axial direction.

As described above, in this embodiment, a vertical type compressor (e.g., a twin type rotary compressor) in which a plurality of compression portions 134 and 135 are arranged in the axial direction may be applied to the dryer 10. In this case, the plurality of compression portions 134 and 135 may be arranged to perform the compression cycle with a phase difference of about 180 degrees. Then, compressor vibrations generated in the plurality of compression portions 134 and 135 may be cancelled by each other. Therefore, vibration of the compressor may be considerably lowered as compared with single type rotary compressors. Accordingly, the vibration nose of the dryer to which the vertical type compressor is applied can be further lowered, and the product reliability of the dryer can be further improved.

However, an empty space between the cabinet 11 and the drum 14 of the dryer 10 may not be sufficiently secured to an extent to which the empty space can accommodate the twin type rotary compressor 100 which is of a vertical type and includes a plurality of compression portion. In this case, the height of the cabinet 11 may be raised or the height of the twin type rotary compressor 100 may be lowered. In the case of the former, the height of the dryer 10 may be increased. In the case of the latter, the casing 100 and the driving motor (exactly an upper insulator) 120 of the compressor 100 are interfered, which may be disadvantageous in terms of assemblability. Moreover, in the case of the latter, it is difficult to secure an insulation distance between the casing 110 and the driving motor 120 of the compressor 100, and therefore, reliability may be deteriorated. In addition, as the oil separation space 110*c* of the casing 110 is reduced to an extent to which the height of the compressor 100 is lowered, oil discharge from the casing 110 is increased, and therefore, cooling power and/or reliability may be deteriorated.

Accordingly, in this embodiment, the cap insertion portion is included in the casing 110 of the vertical type compressor, so that the height of the vertical type compressor 100 can be lowered, the assembly interference between the casing 110 and the driving motor 120 of the vertical type compressor 100 can be prevented, the insulation distance between the casing 110 and the driving motor 120 can be secured, and the oil discharge from the casing 110 can be reduced.

Figure 5:
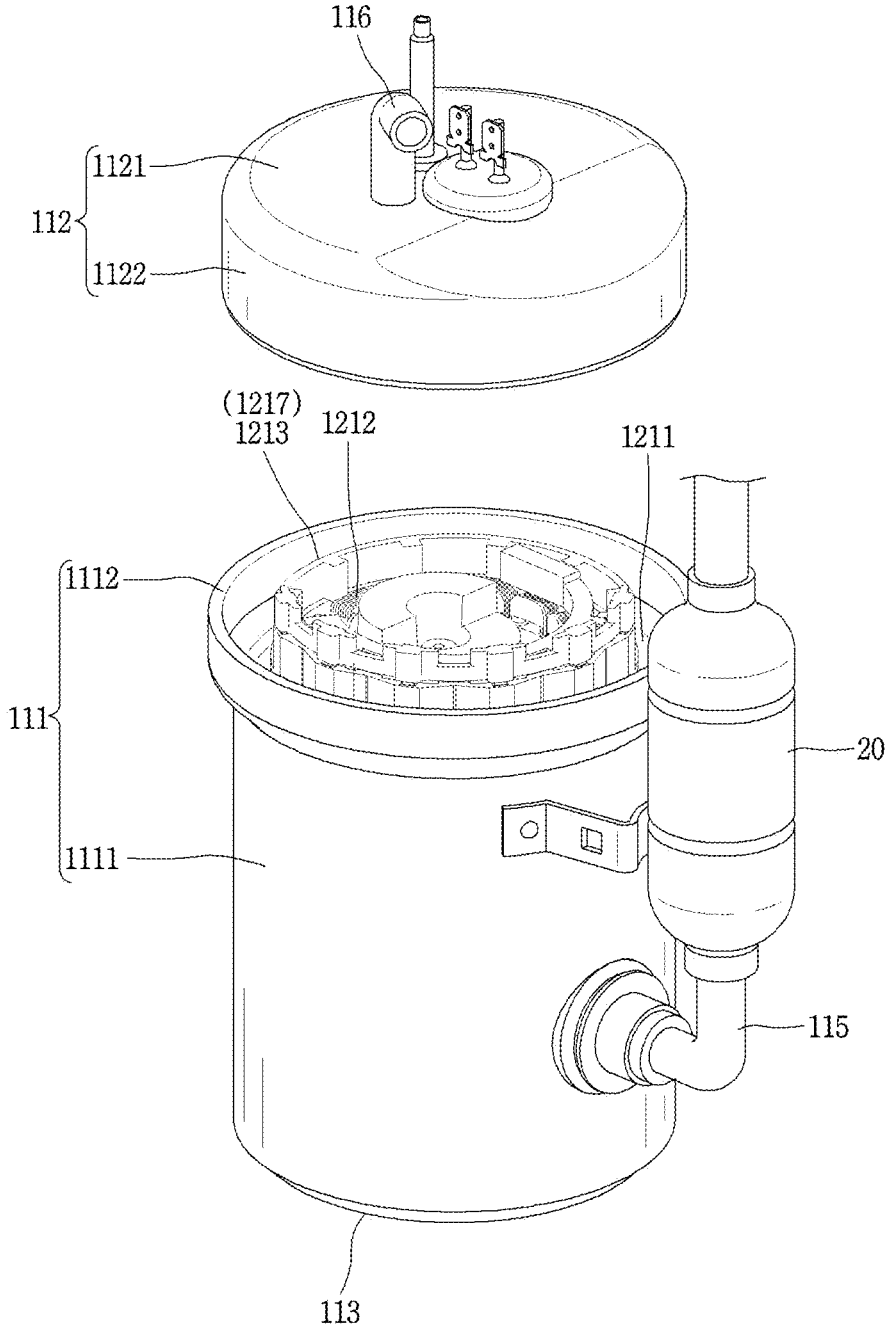
FIG. 5 is an exploded perspective view of the upper cap in the vertical type compressor according to FIG. 2.
Figure 6:
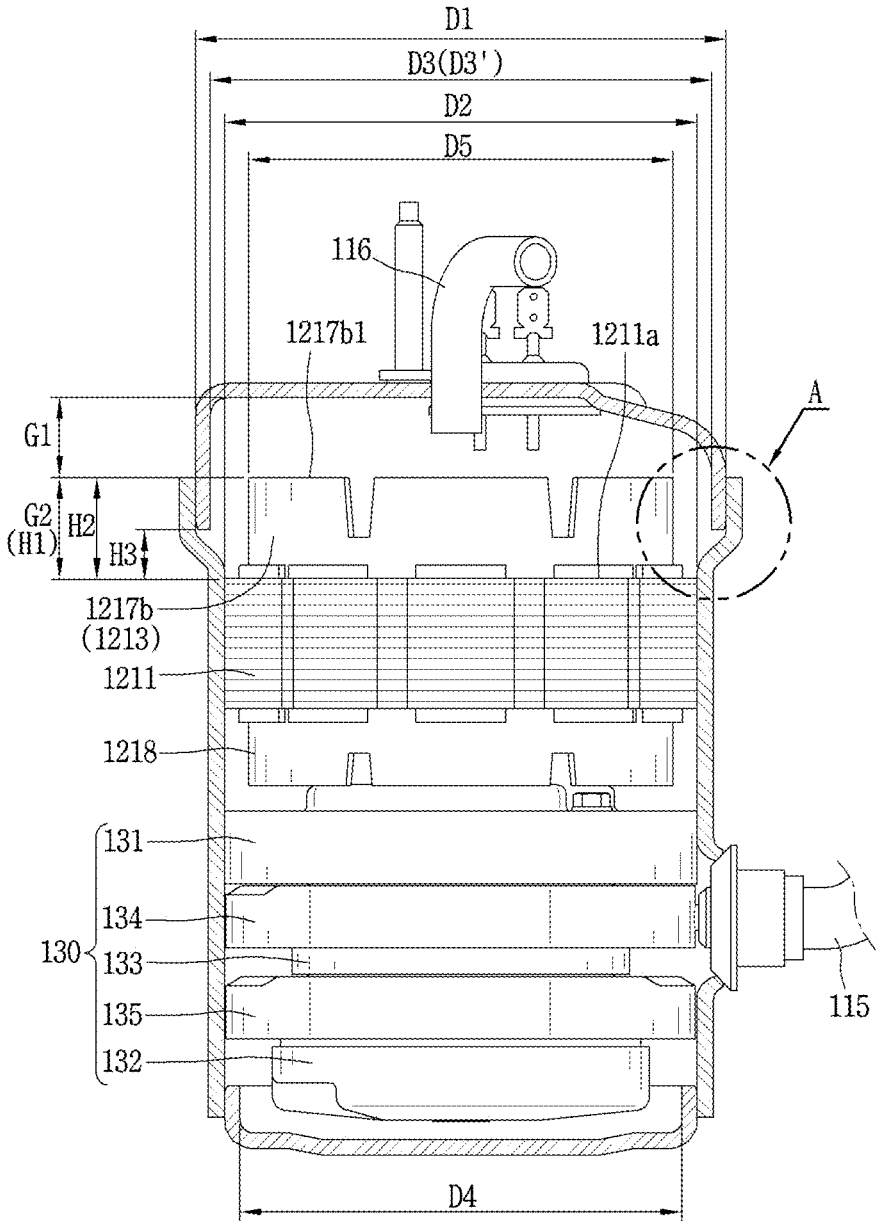
FIG. 6 is a cross-sectional view showing an interior of a casing, illustrating a relationship between the casing and a driving motor in FIG. 5.
Figure 7:
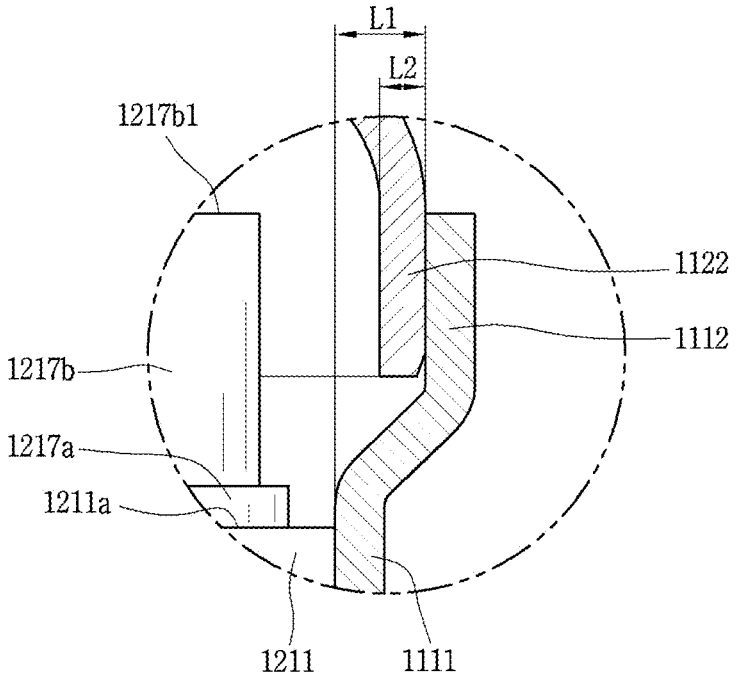
FIG. 7 is an enlarged cross-sectional view of portion "A" of FIG. 6.

FIG. 5 is an exploded perspective view of the upper cap in the vertical type compressor according to FIG. 2, FIG. 6 is a cross-sectional view showing an interior of the casing, illustrating a relationship between the casing and the driving motor in FIG. 5, and FIG. 7 is an enlarged cross-sectional view of portion "A" of FIG. 5.

Referring back to FIG. 3, in the twin type rotary compressor (hereinafter, abbreviated as the rotary compressor) according to this embodiment, the driving motor 120 constituting the electric unit may be arranged in the upper half portion of the middle shell 111 forming a portion of the casing 110, and the first compressor 134 and the second compression portion 135, which constitute the compression mechanism, may be arranged between the main bearing 131 and the sub-bearing 132 along the axial direction with the middle plate 133 interposed therebetween in the lower half portion of the middle shell 111.

Referring to FIGS. 5 to 7, the middle shell 111 according to this embodiment is generally formed in a cylindrical shape, and the cap insertion portion 1112 expanded in a radial direction may be formed at an upper opening end of the middle shell 111. For example, an inner diameter D1 of the cap insertion portion 1112 of the middle shell 111 may be formed larger than an inner diameter D2 of the body portion 1111 of the middle shell 111 except the cap insertion portion 1112. Therefore, an inner circumferential surface of the upper cap 112 inserted into the upper opening end of the middle shell 111 may be connected to an inner circumferential surface of the body portion 1111 of the middle shell 111 at a same height (or on a same surface) along the axial direction, or may be connected to the inner circumferential surface of the body portion 1111 of the middle shell 111 to be stepped outward of the inner circumferential surface of the body portion 1111 of the middle shell 111 in the radial direction. Standards of the cap insertion portion 1112 along with the upper cap 112 and/or the driving motor 120 will be described again later.

The upper cap 112 may be recessed above the rotary shaft 123 in the axial direction to be formed in a dome shape. For example, a cover portion (hereinafter, referred to as an upper cover portion) 1121 may be formed in a substantially disk shape at a central portion of the upper cap 112, and an insertion portion (hereinafter, referred to as an upper insertion portion) 1122 downwardly bent toward the middle shell 111 may be formed in a cylindrical shape at an edge of the upper cover portion 1121. A terminal portion (no reference numeral) for connecting the compressor to an external power source in addition to the above-described refrigerant discharge pipe 116 may be coupled to the upper cover portion 1121 to pass through the upper cover portion 1121, and an outer circumferential surface of the upper insertion portion 1122 may be inserted into an inner circumferential surface of the cap insertion portion 1112 of the middle shell 111 to be welded to the cap insertion portion 1112. Accordingly, support of the cap insertion portion 1112 of the middle shell 111 suppresses an increase in volume of the upper insertion portion 1122 of the upper cap 112 due to thermal deformation in assembly and/or operation of the compressor 100, so that close sealing between the middle shell 111 and the upper cap 112 can be made.

In this case, an inner diameter of the upper insertion portion 1122 of the upper cap 112 (hereinafter, referred to as an inner diameter of the upper cap) D3 may be formed larger than an inner diameter D4 of a lower insertion portion 1132 of the lower cap 113. In other words, the inner diameter D3 of the upper insertion portion 1122 of the upper cap 112, inserted into the cap insertion portion 1112 of the middle shell 111, may be formed larger than the inner diameter D4 of the lower insertion portion 1132 inserted into a lower opening end of the middle shell 111. Accordingly, an insulation distance between the upper cap 112 and the driving motor 120 to be described later is secured, and an oil separation effect in the oil separation space 110*c* of the casing 110 is improved as the inner diameter D3 of the upper cap 112 is expanded, so that oil discharge from the oil separation space 110*c* of the casing 110 can be effectively suppressed.

Also, in this case, the inner diameter D1 of the cap insertion portion 1112 according to this embodiment in the middle shell 111 may be formed larger than the inner diameter D2 of the body portion 1111 in the middle shell 111. For example, the inner diameter D1 of the cap insertion portion 1112 in the middle shell 111 may be formed such that the inner diameter D3 of the upper insertion portion 1122 in the upper cap 112 inserted into the cap insertion portion 1112 of the middle shell 111 is formed larger than or equal to (preferably larger than) the inner diameter D2 of the body portion 1111 in the middle shell 111. Therefore, a radial direction depth L1 from an inner circumferential surface of the body portion 1111 of the middle shell 111 to the inner circumferential surface of the cap insertion portion 1112 of the middle shell 111 may be formed larger than or equal to (preferably larger than) a radial direction thickness L2 of the upper insertion portion 1122 of the upper cap 112. Therefore, an inner circumferential surface of the upper insertion portion 1122 of the upper cap 112 forms at least a same surface as the inner circumferential surface of the body portion 1111 in the middle shell 111, or forms a stepped surface located more distant from an upper insulator 1217 in the radial direction. Accordingly, as described above, an insulation distance between the stator coil 1212 and the casing (exactly the upper cap) 110 can be secured, and the assemblability of the upper cap 112 can be improved while avoiding interference with the upper insulator 1217 in assembly of the upper cap 112.

The lower cap 113 may be recessed below the rotary shaft 123 in the axial direction to be formed in a dome shape. In other words, the lower cap 113 may be formed in a dome shape recessed in a direction opposite to the direction in which the upper cap 113 is recessed. For example, a cover portion (hereinafter, referred to as a lower cover portion) 1131 may be formed in a substantially disk shape at a central portion of the lower cap 113, and an insertion portion (hereinafter, referred to as the lower insertion portion) 1132 upwardly bent toward the middle shell 111 may be formed in a cylindrical shape at an edge of the lower cover portion 1131. A base plate (no reference numeral) mounted in a compressor housing (no reference numeral) may be coupled to the lower cover portion 1131, and the lower insertion portion 1132 may be inserted into the lower opening end of the middle shell 111 to be welded to the middle shell 111. Accordingly, the lower insertion portion 1132 of the lower cap 113 is suppressed from being thermally deformed in assembly and/or operation of the compressor 100, so that close sealing between the middle shell 111 and the lower cap 113 can be made.

Referring to FIGS. 5 to 7, the stator 121 forming a portion of the driving motor 120 according to this embodiment may include the stator core 1211, the stator coil 1212, and the insulator 1213 as described above.

Specifically, the stator core 1211 may be formed in a cylindrical shape. For example, in the stator core 1211, a yoke portion 1215 may be formed in an annular shape, and a plurality of tooth portions 1216 around which the stator coil 1212 is wound may be formed at a predetermined gap along the circumferential direction on an inner circumferential surface of the yoke portion 1215 to each extend in the radial direction.

Also, the stator core 1211 may be press-fitted into the inner circumferential surface of the middle shell 111 to be fixed to the middle shell 111. In other words, the yoke portion 1215 forming an outer circumferential surface of the stator core 1211 may be press-fitted and fixed to the middle shell 111 to be in contact with the inner circumferential surface of the middle shell 111. Therefore, the tooth portions 1216 may be spaced apart from the middle shell 111 in the radial direction.

The stator coil 1212 is wound around the stator core 1211, and may be electrically connected to the external power source through a terminal (no reference numeral) coupled to the casing 110 while passing through the casing 110. In other words, the stator coil 1212 may be wound around each of the plurality of tooth portion 1216 of the stator core 1211, spaced apart from the inner circumferential surface of the middle shell in the radial direction. Therefore, the stator coil 1212 may be spaced apart from the middle shell 111 in the radial direction.

The insulator 1213 may include the upper insulator 1217 and a lower insulator 1218. The upper insulator 1217 may be arranged on an upper side of the stator core 1211 and the lower insulator 1218 may be arranged on a lower side of the stator core 1211. The upper insulator 1217 and the lower insulator 1218 may be generally formed to be symmetric with respect to the stator core 1211. This embodiment relates to a correlation between the upper insulator 1217 and the casing 110. Therefore, hereinafter, the insulator 1213 may be understood as the upper insulator 1217 unless otherwise particularly specified.

Specifically, the upper insulator 1217 may be located between a side surface of the stator core 1211 in the axial direction and the stator coil 1212 wound around the stator core 1211 and between the stator coil 1212 and an inner circumferential surface of the casing (e.g., the middle shell) 110 surrounding the stator coil 1212. Therefore, the insulator 1213 may insulate between the stator core 1211 and the stator coil 1212 and between the stator coil 1212 and the casing 110.

For example, the upper insulator 1217 may include a first insulating portion 1217*a* and a second insulating portion 1217*b*. The first insulating portion 1217*a* is a portion which insulates between the stator core 1211 and the stator coil 1212, and the second insulating portion 1217*b* is a portion which insulates between the stator coil 1212 and the casing 110.

As the first insulating portion 1217*a* extends in the radial direction to be placed on the side surface of the stator core 1211 in the axial direction, i.e., a side surface of each of the tooth portions 1216 in the axial direction, the first insulating portion 1217*a* may be formed in a shape corresponding to each of the tooth portions 1216. Therefore, the first insulating portion 1217*a* may insulate between the stator core 1211 and the stator coil 1212.

The second insulating portion 1217*b* may be bent in the axial direction from an outer circumferential end of the first insulating portion 1217*a* and then extend. The second insulating portion 1217*b* may be formed in one cylindrical shape or may be formed in a plurality of projection shapes protruding in the axial direction between the first insulating portions 1217*a* to be connected to each other in the circumferential direction. In this case, the second insulating portion 1217*b* may be formed higher than an upper end of the stator coil (e.g., a coil assembly) 1212 along the axial direction or may be formed to have a same height as the upper end of the stator coil (e.g., the coil assembly) 1212. Accordingly, the second insulating portion 1217*b* surrounds an outer circumferential side of the stator core 1212, thereby effectively insulating between the stator core 1212 and the casing 110.

Also, at least a portion of the second insulating portion 1217*b* may overlap the cap insertion portion 1112 of the middle shell 111 and/or the upper insertion portion 1122 of the upper cap 112, described above, in the radial direction. In other words, a height H1 from an upper end 1211*a* of the stator core 1211 to an upper end of the upper insulator (exactly the second insulating portion) 1217 may be formed higher than or equal to a height H2 from the upper end 1211*a* of the stator core 1211 to a lower end (exactly a bending end) of the cap insertion portion 1112 and/or a height H3 from the upper end 1211*a* of the stator core 1211 to a lower end (opening end) of the upper insertion portion 1122 of the upper cap 112. Accordingly, as the upper insertion portion 1122 of the upper cap 112 overlaps the upper insulator 1217 of the driving motor 120 in the radial direction, an insulation distance between the casing (exactly upper cap) 110 and the stator coil 1212 can be secured.

In this case, an outer circumferential surface of the second insulating portion 1217*b* may be spaced apart from the inner circumferential surface of the upper insertion portion 1122 of the upper cap 112 by a predetermined gap. In other words, an outer diameter D5 of the upper insulator (exactly the second insulating portion) 1217 may be formed smaller than the inner diameter D3 of the upper insertion portion 1122 of the upper cap 112. Accordingly, as the upper cap 112 is located distant from the upper insulator 1217, the insulation distance between the casing (exactly upper cap) 110 and the stator coil 1212 can be secured, and the assemblability of the upper cap 112 can be improved while avoiding interference with the upper insulator 1217 in assembly of the upper cap 112.

Also, in this case, a maximum axial direction gap G1 between the upper insulator 1217 and an inner circumferential surface of the upper cover portion 1121 of the upper cap 112, facing the upper insulator 1217 in the axial direction, may be formed smaller than or equal to an axial direction gap G2 between an upper end 1217*b*1 of the upper insulator 1217 and the upper end 1211*a* of the stator core 1211. In other words, the maximum axial direction gap G1 from an upper end height of the second insulating portion 1217*b* of the upper insulator 1217 to the inner circumferential surface of the upper cover portion 1121 may be formed smaller than or equal to the height (i.e., a height from the upper end of the stator core to the upper end of the insulator) H1 of the second insulating portion 1217*b* of the upper insulator 1217 in the axial direction. Therefore, as a gap from the driving motor 120 to the upper cap 112 in the axial direction is considerably decreased, the total height of the vertical type compressor is reduced. However, in this case, as the inner diameter D3 of the upper insertion portion 1122 of the upper cap 112 is expanded as described above, an inner diameter D3' in the oil separation space 110*c* is expanded, so that the oil separation effect in the oil separation space 110*c* can be improved.

Figure 8:
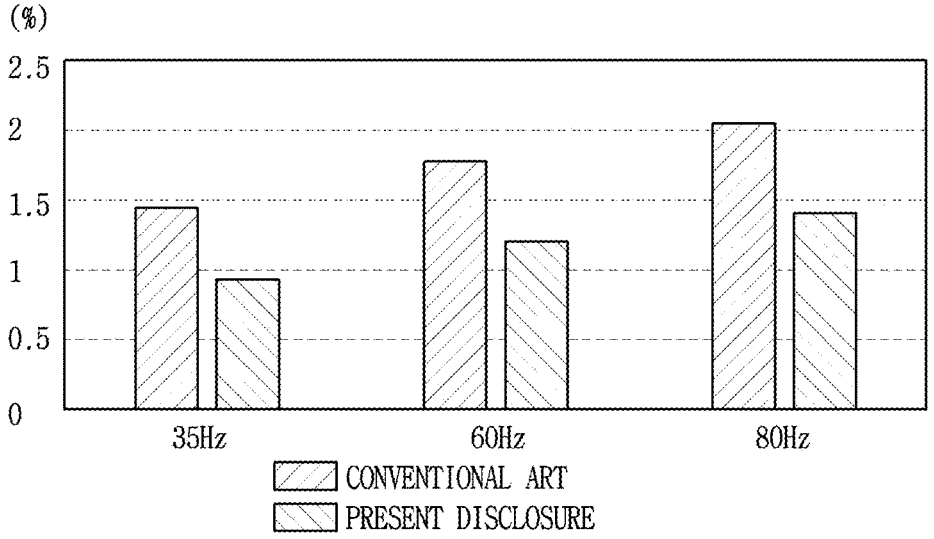
FIG. 8 is a graph comparing an oil discharge effect of the vertical type compressor according to this embodiment with a conventional vertical type compressor.

This can be seen through FIG. 8. FIG. 8 is a graph comparing an oil discharge effect of the vertical type compressor according to this embodiment with a conventional vertical type compressor.

As illustrated in FIG. 8, it can be seen that in this embodiment, oil discharge is considerably reduced even in a relatively low-speed operation condition (38 Hz) in addition to a relatively high-speed operation condition (80 Hz), as compared with the conventional vertical type compressor. This may be because the oil separation space 110*c* is expanded as the cap insertion portion 1112 of the middle shell 111 is formed and the inner diameter D3 of the upper cap 112 is expanded, and accordingly, the oil separation effect is improved as a residence time of the refrigerant discharged from the compression portions 134 and 135 in the oil separation space 110*c* is increased.

Meanwhile, although the twin type rotary compressor including two cylinders has been described as an example in the above-described embodiment, this may be equally applied to not only a multiple type rotary compressor in which three or more cylinders are arranged along the axial direction but also a single type rotary compressor including one cylinder in some cases. This is the same as the above-described embodiment, and therefore, its detailed description is replaced with the description of the above-described embodiment.

What is claimed is:

1. A vertical type compressor, comprising:

a driving motor comprising a stator in which a stator coil is wound around a stator core, a rotor rotatably arranged on an inner circumferential side of the stator, and a rotary shaft coupled to the rotor to rotate together with rotor;

a compression unit arranged at one side of the driving motor and comprising at least one compression portion which compresses a refrigerant while being operated by a driving force transmitted through the rotary shaft; and a casing comprising a middle shell formed in a cylindrical shape and a cap inserted into an opening end of the middle shell to be coupled to the middle shell, wherein the middle shell comprises:

a body portion accommodating the driving motor and the compression unit therein; and a cap insertion portion arranged at one end of the body portion such that the cap is inserted thereinto, and expanded in a radial direction of the rotary shaft, wherein an insulator is located between the stator core facing the cap and the stator coil on a section of the stator core in an axial direction, wherein at least a portion of the insulator overlaps the cap insertion portion in the radial direction of the rotary shaft, and wherein a height from an upper end of the stator core facing the cap in the axial direction to an upper end of the insulator is formed higher than or equal to a height from the upper end of the stator core to a lower end of the cap insertion portion and/or a height from the upper end of the stator core to the opening end of the cap inserted into the cap insertion portion.

2. The vertical type compressor of claim 1, wherein an opening end of the cap inserted into the cap insertion portion overlaps at least a portion of the driving motor in the radial direction of the rotary shaft.

3. The vertical type compressor of claim 2, wherein a radial direction depth from an inner circumferential surface of the body portion to an inner circumferential surface of the cap insertion portion is formed larger than or equal to a thickness of the opening end of the cap inserted into the cap insertion portion.

4. The vertical type compressor of claim 1, wherein at least a portion of the insulator overlaps the opening end of the cap in the radial direction of the rotary shaft.

5. The vertical type compressor of claim 1, wherein an insulator is located between the stator core facing the cap and the stator coil on a section of the stator core in an axial direction, and wherein an outer circumferential surface of the insulator is spaced apart from an inner circumferential surface of the opening end of the cap inserted into the cap insertion portion by a predetermined gap.

6. The vertical type compressor of claim 5, wherein an inner diameter of the opening end of the cap inserted into the cap insertion portion is formed larger than an outer diameter of the insulator.

7. The vertical type compressor of claim 1, wherein the cap comprises:

a cover portion covering the opening end of the middle shell; and an insertion portion extending from the cover portion to be inserted into the opening end of the middle shell, wherein an insulator is located between the stator core facing the cap and the stator coil on a section of the stator core in an axial direction, and wherein a maximum axial direction gap between the insulator and an inner circumferential surface of the cover portion of the cap facing the insulator is formed smaller than or equal to a height from an upper end of the stator core and an upper end of the insulator.

8. The vertical type compressor of claim 1, wherein the middle shell has both open ends in an axial direction, a first cap and a second cap are respectively inserted into both the ends of the middle shell in the axial direction to be coupled to the middle shell, and a refrigerant discharge pipe is coupled to the first cap to communicate with an internal space of the casing, and wherein an inner diameter of the first cap is formed larger than an inner diameter of the second cap.

9. The vertical type compressor of claim 8, wherein the first cap is located upwardly of the second cap with respect to an installation surface.

10. A laundry treating apparatus, comprising:

a cabinet;

a drum rotatably arranged inside the cabinet to accommodate clothing and having heated air provided thereto to dry the accommodated clothing; and a compressor located between a bottom surface of the cabinet and the drum on the bottom surface of the cabinet, wherein the compress or comprising:

a driving motor comprising a stator in which a stator coil is wound around a stator core, a rotor rotatably arranged on an inner circumferential side of the stator, and a rotary shaft coupled to the rotor to rotate together with rotor;

a compression unit arranged at one side of the driving motor and comprising at least one compression portion which compresses a refrigerant while being operated by a driving force transmitted through the rotary shaft; and a casing comprising a middle shell formed in a cylindrical shape and a cap inserted into an opening end of the middle shell to be coupled to the middle shell, wherein the middle shell comprises:

a body portion accommodating the driving motor and the compression unit therein; and a cap insertion portion arranged at one end of the body portion such that the cap is inserted thereinto, and expanded in a radial direction of the rotary shaft, wherein an insulator is located between the stator core facing the cap and the stator coil on a section of the stator core in an axial direction, wherein at least a portion of the insulator overlaps the cap insertion portion in the radial direction of the rotary shaft, and wherein a height from an upper end of the stator core facing the cap in the axial direction to an upper end of the insulator is formed higher than or equal to a height from the upper end of the stator core to a lower end of the cap insertion portion and/or a height from the upper end of the stator core to the opening end of the cap inserted into the cap insertion portion.

11. The laundry treating apparatus of claim 10, wherein an opening end of the cap inserted into the cap insertion portion overlaps at least a portion of the driving motor in the radial direction of the rotary shaft.

12. The laundry treating apparatus of claim 11, wherein a radial direction depth from an inner circumferential surface of the body portion to an inner circumferential surface of the cap insertion portion is formed larger than or equal to a thickness of the opening end of the cap inserted into the cap insertion portion.

13. The laundry treating apparatus of claim 10, wherein an insulator is located between the stator core facing the cap and the stator coil on a section of the stator core in an axial direction, and wherein an outer circumferential surface of the insulator is spaced apart from an inner circumferential surface of the opening end of the cap inserted into the cap insertion portion by a predetermined gap.

14. The laundry treating apparatus of claim 10, wherein the cap comprises:

a cover portion covering the opening end of the middle shell; and an insertion portion extending from the cover portion to be inserted into the opening end of the middle shell, wherein an insulator is located between the stator core facing the cap and the stator coil on a section of the stator core in an axial direction, and wherein a maximum axial direction gap between the insulator and an inner circumferential surface of the cover portion of the cap facing the insulator is formed smaller than or equal to a height from an upper end of the stator core and an upper end of the insulator.

15. The laundry treating apparatus of claim 10, wherein the middle shell has both open ends in an axial direction, a first cap and a second cap are respectively inserted into both the ends of the middle shell in the axial direction to be coupled to the middle shell, and a refrigerant discharge pipe is coupled to the first cap to communicate with an internal space of the casing, and wherein an inner diameter of the first cap is formed larger than an inner diameter of the second cap.

16. The laundry treating apparatus of claim 10, wherein the vertical type compressor comprises a first compression portion and a second compression portion, each of which has a compression space, wherein a first eccentric portion constituting the first compression portion and a second eccentric portion constituting the second compression portion are formed along an axial direction on the rotary shaft, and wherein the first eccentric portion and the second eccentric portion are formed with a phase difference of 180 degrees.

17. A vertical type compressor, comprising:

a driving motor comprising a stator in which a stator coil is wound around a stator core, a rotor rotatably arranged on an inner circumferential side of the stator, and a rotary shaft coupled to the rotor to rotate together with rotor;

a compression unit arranged at one side of the driving motor and comprising at least one compression portion which compresses a refrigerant while being operated by a driving force transmitted through the rotary shaft; and a casing comprising a middle shell formed in a cylindrical shape and a cap inserted into an opening end of the middle shell to be coupled to the middle shell, wherein the middle shell comprises:

a body portion accommodating the driving motor and the compression unit therein; and a cap insertion portion arranged at one end of the body portion such that the cap is inserted thereinto, and expanded in a radial direction of the rotary shaft, wherein the middle shell has both open ends in an axial direction, a first cap and a second cap are respectively inserted into both the ends of the middle shell in the axial direction to be coupled to the middle shell, and a refrigerant discharge pipe is coupled to the first cap to communicate with an internal space of the casing, and wherein an inner diameter of the first cap is formed larger than an inner diameter of the second cap.

18. The vertical type compressor of claim 17, wherein the first cap is located upwardly of the second cap with respect to an installation surface.

* * * * *